US006610617B2

(12) United States Patent
Chiou

(10) Patent No.: US 6,610,617 B2
(45) **Date of Patent: *Aug. 26, 2003**

(54) BALLISTIC RESISTANT ARTICLE

(75) Inventor: Minshon J. Chiou, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 42 days.

This patent is subject to a terminal disclaimer.

(21) Appl. No.: 09/833,454

(22) Filed: Apr. 12, 2001

(65) Prior Publication Data

US 2003/0008583 A1 Jan. 9, 2003

(51) Int. Cl.[7] ..... D03D 13/00

(52) U.S. Cl. ..... 442/203; 442/208; 442/209; 442/213; 442/215; 442/239; 442/246; 442/251; 442/254; 428/902; 428/911

(58) Field of Search ..... 428/911, 902, 428/203, 208; 442/232, 209, 234, 213, 378, 217, 215, 239, 246, 251, 254

(56) References Cited

U.S. PATENT DOCUMENTS

| | | | | |
|---|---|---|---|---|
| 3,094,511 | A | 6/1963 | Hill ett al. | |
| 3,354,127 | A | 11/1967 | Hill et al. | |
| 3,673,143 | A | 6/1972 | Bair et al. | |
| 3,819,587 | A | 6/1974 | Kwoleck | |
| 3,869,429 | A | 3/1975 | Blades | |
| 4,172,938 | A | 10/1979 | Mera et al. | |
| 4,287,607 | A | 9/1981 | Leach | |
| 4,308,374 | A | 12/1981 | Vollbracht et al. | |
| 4,457,985 | A | 7/1984 | Harpell et al. | |
| 4,698,414 | A | 10/1987 | Bair | |
| 4,850,050 | A | 7/1989 | Droste et al. | |
| 5,187,003 | A | 2/1993 | Chitrangad | |
| 6,103,646 | A | 8/2000 | Chiou | |
| 6,133,169 | A | * 10/2000 | Chiou et al. | 428/911 |

FOREIGN PATENT DOCUMENTS

| | | | |
|---|---|---|---|
| EP | 0 291 859 | A | 11/1988 |
| EP | 0 310 199 | A | 4/1989 |
| WO | WO 93/00564 | A1 | 1/1993 |
| WO | WO 00 37876 | A | 6/2000 |
| WO | WO 00 42246 | A | 7/2000 |

OTHER PUBLICATIONS

Melliand Textiberichte, Structure and Action of Bullet–Resistant Protective Vests, No 6. pp. 463–468 (1981) [German Original].

Melliand Textiberichte, Structure and Action of Bullet–Resistant Protective Vests, No 6. pp. 463–468 (1981) [English Translation].

Weaving: Conversion of Yarns to Fabric, Lord, and Mohames, Published by Merrow (1982), pp. 141–143.

* cited by examiner

*Primary Examiner*—Ula Ruddock

(57) ABSTRACT

A flexible ballistic resistant article is disclosed that includes a plurality of layers of fabric having an areal density of 2 to 10 kg/m$^2$, wherein at least two of the layers of fabric are loosely woven. The loosely woven fabric layers include fabric woven with a fabric tightness factor of 0.3 to 0.6 and are made using continuous filament yarns with a linear density of at least 200 dtex, a tenacity of at least 10 grams per dtex and a tensile modulus of at least 150 grams per dtex. Adjacent loosely woven fabric layers are joined together by means for securing the layers to restrict the movement of the loosely woven fabric layers relative to one another.

12 Claims, No Drawings

BALLISTIC RESISTANT ARTICLE

BACKGROUND OF THE INVENTION

1. Field of the Invention

This invention relates to the field of ballistic resistant articles.

2. Description of the Related Art

There is an ongoing need in the art to provide articles, such as vests, garments, and the like, that have an improved ballistic resistance while at the same time are comfortable to wear. Prior art efforts to increase the ballistic resistance of an article have focused on either increasing the strength or decreasing the denier of fibers used in these articles.

For example, International Publication No. WO 93/00564, discloses ballistic structures using layers of fabric woven from high tenacity para-aramid yarns.

U.S. Pat. No. 4,850,050 discloses body armor made from p-aramid yarns comprising filaments of low individual linear density. The ballistic performance of body armor made in accordance with that invention was reported to represent a 5% improvement over a comparison fabric of the prior art.

Melliand Textilberichte, Structure and Action of Bullet-Resistant Protective Vests, No. 6, pp. 463–8 (1981) discloses that fabrics of fine aramid yarns, for example, 220 or 440 dtex, provide better ballistic protection than fabrics made from coarser yarns.

U.S. Pat. No. 5,187,003 discloses a fabric useful for ballistic protection which has dissimilar fibers in the warp and weft directions. With regard to the fabric cover factor, it is indicated that fabric with a cover factor of less than 0.6 would be too loose for effective ballistic protection.

U.S. Pat. No. 4,287,607 discloses a ballistic vest made from a plurality of double cloth layers of loosely woven aramid fiber with nylon film or nylon fabric interposed between some the layers of double woven cloth. Those double cloth layers have a fabric tightness factor, as defined herein, of about 0.71.

SUMMARY OF THE INVENTION

The invention relates to a flexible ballistic resistant article comprising a plurality of layers of fabric having an areal density of 2 to 10 kg/m$^2$, wherein at least two of the layers of fabric are loosely woven. The loosely woven fabric layers include fabric woven with a fabric tightness factor of 0.3 to 0.6 and are made using continuous filament yarns with a linear density of at least 200 dtex, a tenacity of at least 10 grams per dtex and a tensile modulus of at least 150 grams per dtex. Adjacent loosely woven fabric layers are joined together by means for securing the layers to restrict the movement of the loosely woven fabric layers relative to one another.

DETAILED DESCRIPTION

The present invention is directed to a flexible ballistic resistant article. The article includes a plurality of woven fabric layers, wherein at least two of those layers are loosely woven. The loosely woven layers are joined together to restrict the relative movement of those layers to one another. The article, quite surprisingly, exhibits improved ballistic resistance.

The inventor herein has discovered that the ballistic resistance of a fabric is dramatically improved when the article includes layers of fabric having yarns that are woven to a tightness factor of less than 0.6. It is believed that a tightness factor as low as 0.3 provides improved ballistic resistance. As used herein, the term "loosely woven" as applied to fabric layers means a fabric layer having yarns that are woven to a tightness factor of from about 0.3 to about 0.6.

Until the present invention, ballistic resistant fabrics were tightly woven. In efforts completely opposite to the current technical understanding, the inventor herein discovered that fabrics that are loosely woven exhibit improved ballistic resistance. While any fabrics with any reduced tightness factor are expected to exhibit some improvement, the most improvement is found at a tightness factor of less than 0.6. As the tightness factor is further reduced, ballistic resistance is further improved until the tightness factor reaches about 0.3, where the fabric weave is so loose that an unacceptably high areal density would be required for effective ballistic protection.

The ballistic article of the invention is made using a plurality of layers of protective fabric, and includes at least two layers of loosely woven fabric. The loosely woven layers are fastened together by means for securing those layers of fabric to restrict the movement of those layers relative to one another. This securing means may be any means normally used to secure layers of fabric together such as sewing, stitching, adhesives and/or tapes. There is no limitation as to how the loosely woven layers are sewn and/or stitched together. The sewing and/or stitching may be around the edges of those layers, or across the layers such as by diagonal sewing and/or stitching or quilt-like sewing and/or stitching.

The other layers of fabric may also be fastened together by securing means but it is not critical that those other layers be fastened together such that there is no relative movement of those layers to one another.

The construction of the ballistic article of this invention is in contrast to a knife stab penetration resistant article where adjacent layers of a protective fabric are not held together but are free to move relative to each other to increase the knife stab penetration resistance of that article.

The invention herein is constructed entirely of woven fabric without the need for rigid plates or platelets and without the need for matrix resins or binders coating or impregnating the fabric materials. However, such rigid plates or platelets or matrix resins or binders may be used with the article of the invention.

The articles of this invention are more flexible, lighter in weight, softer to the touch, more comfortable to be worn, and more pliable than conventional ballistic resistant constructions of the prior art.

Fabrics of the present invention, including the loosely woven fabric layers, are made in whole or in part from yarns having a tenacity of at least 10 grams per dtex and a tensile modulus of at least 150 grams per dtex. Such yarns can be made from aramids, polyolefins, polybenzoxazole, polybenzothiazole, and the like; and, if desired, the fabrics can be made from mixtures of such yarns. For example, the fabrics may include yarns of one type in the weft direction and yarns of a different type in the fill direction.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramids are the primary polymers in aramid yarn fibers of this invention and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. Preparation of PPD-T is described in U.S. Pat. Nos. 3,869,429; 4,308,374; and 4,698,414.

By "polyolefin" is meant polyethylene or polypropylene. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE). Similarly, polypropylene is a predominantly linear polypropylene material of preferably more than one million molecular weight. High molecular weight linear polyolefin fibers are commercially available. Preparation of polyolefin fibers is discussed in U.S. Pat. No. 4,457,985.

Polybenzoxazole and polybenzothiazole are preferably made up of mers of the following structures:

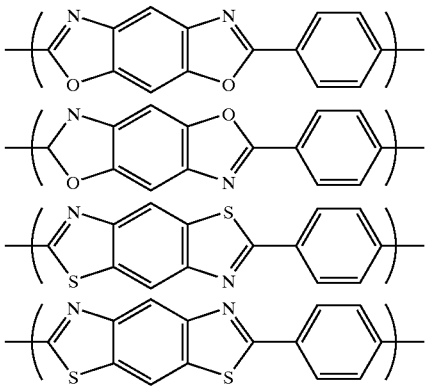

-continued

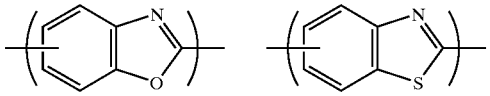

While the aromatic groups shown joined to the nitrogen atoms may be heterocyclic, they are preferably carbocyclic; and while they may be fused or unfused polycyclic systems, they are preferably single six-membered rings. While the group shown in the main chain of the bis-azoles is the preferred para-phenylene group, that group may be replaced by any divalent organic group which doesn't interfere with preparation of the polymer, or no group at all. For example, that group may be aliphatic up to twelve carbon atoms, tolylene, biphenylene, bis-phenylene ether, and the like.

The polybenzoxazole and polybenzothiazole used to make fibers of this invention should have at least 25 and preferably at least 100 mer units. Preparation of the polymers and spinning of those polymers is disclosed in the aforementioned International Publication Wo 93/20400.

"Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141–143):

$$d_w = \text{width of warp yarn in the fabric}$$

$$d_f = \text{width of fill yarn in the fabric}$$

$$P_w = \text{pitch of warp yarns (ends per unit length)}$$

$$p_f = \text{pitch of fill yarns}$$

$$C_w = \frac{d_w}{pw} \quad C_f = \frac{d_f}{pf}$$

$$\text{Fabric Cover Factor} = C_{fab} = \frac{\text{total area obscured}}{\text{area enclosed}}$$

$$C_{fab} = \frac{(p_w - d_w)d_f + d_w p_f}{p_w p_f} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor that is possible for a plain weave fabric is 0.75; and a plain weave fabric with an actual cover factor of 0.45 will, therefore, have a fabric tightness factor of 0.60. Different fabric weaves, such as plain, twill or satin weaves and their variants, can be used as the fabric for this invention. The preferred weave for practice of this invention are twill and satin weaves and their variants, including crowfoot weave, sometimes known as 4-harness satin weave, since they are more flexible and pliable than the plain weave and can better conform to complex curves and surfaces.

The yarns used in this invention must have a high tenacity of at least 10 grams per dtex (11.1 grams per denier) and there is no known upper limit for tenacity. Below a tenacity of about 5 grams per dtex, the yarn doesn't exhibit adequate strength for meaningful protection. The yarns must have a tensile modulus of at least 150 g/dtex because too low a modulus will result in excessive fiber stretching and ineffective restriction of the movement of a bullet. There is no known upper limit for tensile modulus.

A single layer of the woven fabric of this invention would provide a measure of ballistic resistance and, therefore, a degree of protection; but a plurality of layers with at least two loosely woven fabric layers are required in an ultimate ballistic resistant article. It is in the use of a plurality of fabric layers with a total areal density, which is measured by the total weight of the fabric layers per unit area, of at least 2 to 10 kg/m$^2$, preferably 2.5 to 8 kg/m$^2$, wherein at least two of the fabric layers being loosely woven fabric layers, that the present invention exhibits its most pronounced and surprising improvement. It has been discovered that loosely woven fabric layers of this invention, when placed together, preferably in a plurality of layers, afford a surprisingly effective ballistic resistance when the loosely woven fabric layers are affixed to one another to restrict relative movement between adjacent layers.

The construction of protective articles of this invention may also be used in conjunction with other networks of fibers of woven or non-woven ballistic layers, such as unidirectional, uni-weave, or the like. These layers can be made from aramids, polyolefins, polybenzoxazoles, polybenzothiazoles, or other polymers usually used for ballistic protection. Fabric layers of this invention can be positioned underlie or overlie other ballistic layers, or between two other ballistic layers. Fabric of this invention can also be coated or impregnated with matrix resins or binders to increase the rigidity of the fabric layer if needed.

Test Methods

Linear Density. The linear density of a yarn or a filament is determined by weighing a known length of the yarn or filament. "Dtex" is defined as the weight, in grams, of 10,000 meters of the material. "Denier" is the weight, in grams, of 9000 meters of the material.

In actual practice, the measured dtex of a yarn or filament sample, test conditions, and sample identification are fed into a computer before the start of a test; the computer records the load-elongation curve of the sample as it is broken and then calculates the properties.

Tensile Properties. Yarns tested for tensile properties are, first, conditioned and, then, twisted to a twist multiplier of 1.1. The twist multiplier™ of a yarn is defined as:

$$TM = (\text{twists/cm})(dtex)^{-1/2}/30.3$$
$$= (\text{twists/inch})(denier)^{-1/2}/73$$

The yarns to be tested are conditioned at 25° C., 55% relative humidity for a minimum of 14 hours and the tensile tests are conducted at those conditions. Tenacity (breaking tenacity), elongation to break, and tensile modulus are determined by breaking test yarns on an Instron tester (Instron Engineering Corp., Canton, Mass.).

Tenacity, elongation, and tensile modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn linear density.

Tenacity, elongation, and tensile modulus of individual filaments are determined in the same way as for yarns; but filaments are not subjected to twist and a gage length of 2.54 cm is used.

Ballistics Performance. Ballistic tests of the multi-layer panels were conducted to determine the ballistic limit (V50) in accordance with MIL-STD-662e, except in the selection of projectiles, as follows: A panel to be tested was placed against a backing material of Roma Plastina No. 1 clay in a sample mount to hold the panel taut and perpendicular to the path of test projectiles. The projectiles were 9 mm full metal jacket hand-gun bullets weighing 124 grains and 0.357 magnum jacketed soft point bullet weighing 158 grains, and were propelled from a test barrel capable of firing the projectiles at different velocities. The first firing for each panel was for a projectile velocity estimated to be the likely ballistics limit (V50). When the first firing yielded a complete panel penetration, the next firing was for a projectile velocity of about 15.5 meters (50 feet) per second less in order to obtain a partial penetration of the panel. On the other hand, when the first firing yielded no penetration or partial penetration, the next firing was for a velocity of about 15.2 meters (50 feet) per second more in order to obtain a complete penetration. After obtaining one partial and one complete projectile penetration, subsequent velocity increases or decreases of about 15.2 meters (50 feet) per second were used until enough firings are made to determine the ballistics limit (V50) for that panel.

The ballistics limit (V50) was calculated by finding the arithmetic mean of an equal number of at least three of the highest partial penetration impact velocities and the lowest complete penetration impact velocities, provided that there was a difference of not more than 38.1 meters (125 feet) per second between the highest and lowest individual impact velocities.

EXAMPLES

In the following examples, composites of a plurality of fabric layers were tested for ballistic resistance penetration. Ballistic panels of 16"×16" were constructed for the test, wherein all of the fabric layers were sewn around the edges and were additionally sewn diagonally with cross-stitches. Several different fabrics with different tightness factors made from yarns of different materials and those fabrics were tested at various fabric tightness factors and with areal densities between 5.4 and 6.2 kg/m$^2$.

Examples 1–4 and Comparative Example 5

A plurality layers of woven aramid yarn were prepared for these examples. The yarn was aramid yarn sold by E.I. du Pont de Nemours and Company under the trademark Kevlar®. The aramid was poly(p-phenylene terephthalamide).

In Example 1, forty (40) layers of fabric were woven from 1111 dtex Kevlar® 29 in a plain weave at 6.3×6.3 ends per centimeter with a fabric tightness factor of 0.59 and an areal density of about 5.8 kg/m$^2$. In Example 2, 40 layers of fabric were made as in Example 1 except that the fabric was made in a crowfoot weave at 6.7×6.7 ends per centimeter, and the fabric had a fabric tightness factor of 0.53 and an areal density of about 6.2 kg/m $^2$.

In Example 3, forty layers (40) of fabric were woven from 933 dtex Kevlar® 129 in a plain weave at 7×7 ends per centimeter with a fabric tightness factor of 0.6 and an areal density of about 5.4 kg/m$^2$. In Example 4, 40 layers of fabric were made as in Example 3 except that the fabric was made in a crowfoot weave at 7.9×7.9 ends per centimeter, and the fabric had a fabric tightness factor of 0.56 and an areal density of about 5.8 kg/m$^2$.

In Comparative Example 5, a fabric was made that had approximately the same areal density as the fabrics of Examples 1–4. The fabric included twenty-two (22) layers of tightly woven fabric of 933 dtex Kevlar® 129 were made in a plain weave at 12.2×12.2 ends per centimeter with a fabric tightness factor of 0.93 and an areal density of about 5.4 kg/M$^2$.

The construction of the fabrics in Examples 1–4 and Comparative Example 5 is summarized in Table 1 below.

The layers of fabrics in Examples 1–4 and Comparative Example 5 were tested for ballistic V50 against 9 mm, and 0.357 mag bullets. The ballistic test results, shown in Table 2, indicate the V50 results for the articles of this invention as shown in Examples 1–4 were significantly greater than the V50 of the article of Comparative Example 5. In summary, the articles of the invention showed an improvement of from about 7.5 to 13% compared to the article of Comparative Example 5.

TABLE 1

| Example No. | Fabric Construction | Fabric Tightness Factor | Area Density (kg/m$^2$) |
|---|---|---|---|
| 1 | 40 layers, 1111 dtex yarn<br>Plain weave, 6.3 × 6.3 ends/cm | 0.59 | 5.8 |
| 2 | 40 layers, 1111 dtex yarn<br>Crowfoot weave, 6.7 × 6.7 ends/cm | 0.53 | 6.2 |
| 3 | 40 layers, 933 dtex yarn<br>Plain weave, 7 × 7 ends/cm | 0.60 | 5.4 |
| 4 | 40 layers, 933 dtex yarn<br>Crowfoot weave, 7.9 × 7.9 ends/cm | 0.56 | 5.8 |
| Comparative Ex. 5 | 22 layers, 933 dtex yarn<br>Plain weave, 12.2 × 12.2 ends/cm | 0.93 | 5.4 |

TABLE 2

| | 9 mm | | .357 mag. | |
|---|---|---|---|---|
| Example No. | V50 | % Improvement | V50 | % Improvement |
| 1 | 1696 ft/sec | 9.1 | 1652 | 7.5 |
| 2 | 1711 | 10.1 | 1664 | 8.3 |
| 3 | 1731 | 11.4 | 1691 | 10.0 |
| 4 | 1741 | 12.0 | 1737 | 13.0 |
| Comparative Ex. 5 | 1554 | Base | 1537 | base |

Examples 6–7 and Comparative Example 8

A plurality layers of woven polybenzoxazole (PBO) yarn were prepared for these examples. The yarn was sold by Toyobo Co., Ltd. under the tradename of Zylon®.

In Example 6, forty (40) layers of fabric were woven from 1111 dtex Zylon®, in a plain weave at 6.3×6.3 ends per centimeter with a fabric tightness factor of 0.59 and an areal density of about 5.8 kg/m$^2$. In Example 7, thirty five (35) layers of fabric were made as in Example 6 except that the fabric was made in a crowfoot weave at 7.5×7.5 ends per centimeter, and the fabric had a fabric tightness factor of 0.58 and an areal density of about 5.9 kg/M$^2$.

In Comparative Example 8, thirty (30) layers of fabric woven from 1111 dtex Zylon® made at 8.7×8.3 ends per centimeter with a fabric tightness factor of 0.76 and an areal density of about 5.8 kg/m$^2$.

The construction of the fabrics in Examples 6–7 and Comparative Example 8 are summarized in Table 3 below.

The layers of fabrics in Examples 6–7 and Comparative Example 8 were tested as described above for Examples 1–4 and Comparative Example 5. The ballistic test results against 9 mm and 0.357 mag bullets, as shown in Table 4, indicated that V50 results for the articles of this invention were significantly higher than the V50 of Comparative Example 8. In summary, the articles of the invention showed an improvement of from about 5.9 to 13% compared to the article of Comparative Example 8.

TABLE 3

| Example No. | Fabric Construction | Fabric Tightness Factor | Area Density (kg/m$^2$) |
|---|---|---|---|
| 6 | 40 layers, 1111 dtex yarn<br>Plain weave, 6.3 × 6.3 ends/cm | 0.59 | 5.9 |
| 7 | 35 layers 1111 dtex yarn<br>Crowfoot weave, 7.5 × 7.5 ends/cm | 0.58 | 5.9 |
| Comparative Ex. 8 | 30 layers, 1111 dtex yarn<br>Plain weave, 8.7 × 8.3 ends/cm | 0.76 | 5.9 |

TABLE 4

| | 9 mm | | .357 mag. | |
|---|---|---|---|---|
| Example No. | V50 | % Improvement | V50 | % Improvement |
| 6 | 2033 ft/sec | 10.5 | 2047 | 9.5 |
| 7 | 2076 | 13 | 1981 | 5.9 |
| Comparative Ex. 8 | 1839 | Base | 1870 | base |

What is claimed is:

1. A flexible ballistic resistant article comprising a plurality of layers of fabric having an areal density of 2 to 10 kg/m$^2$, wherein at least two of the layers of fabric are loosely woven, the loosely woven fabric layers comprising fabric woven with a fabric tightness factor of 0.3 to 0.6 and comprising continuous filament yarns with a linear density of at least 200 dtex having a tenacity of at least 10 grams per dtex and a tensile modulus of at least 150 grams per dtex, wherein adjacent loosely woven fabric layers are joined together by means for securing the layers to restrict the movement of the loosely woven fabric layers relative to one another.

2. The flexible ballistic resistant article of claim 1, wherein the article has an areal density of from 2.5 to 8 kg/m$^2$.

3. The flexible ballistic resistant article of claim 1 wherein the loosely woven fabric layers include a matrix resin or binder.

4. The flexible ballistic resistant article of claim 1 wherein the loosely woven fabric layers comprise aramid yarns.

5. The flexible ballistic resistant article of claim 4 wherein the aramid yarns are poly (p-phenylene terephtahlamide) yarns.

6. The flexible ballistic resistant article of claim 1 wherein the loosely woven fabric layers comprise polyolefin yarns.

7. The flexible ballistic resistant article of claim 1 wherein the loosely woven fabric layers comprise polybenzoxazole or polybenzothiazole yarns.

8. The flexible ballistic resistant article of claim 1 wherein the yarns in the warp direction and the fill direction of the loosely woven fabric layers are different.

9. The flexible ballistic resistant article of claim 8 wherein the yarns in the warp direction comprise aramid and the yarns in the fill direction comprise polybenzoxazole or polybenzothiazole.

10. The flexible ballistic resistant article of claim 8 wherein the yarns in the warp direction comprise polybenzoxazole or polybenzothiazole and the yarns in the fill direction comprise aramid.

11. The flexible ballistic resistant article of claim 1 wherein the loosely woven fabric layers comprise yarns having a linear density of 0.5 to 8 dtex.

12. The flexible ballistic resistant article of claim 1 having a sufficient number of loosely woven fabric layers such that the article has a ballistic V50 of greater than 320 m/sec for a 9 mm bullet.

* * * * *